US011324289B2

(12) United States Patent
Schapson

(10) Patent No.: US 11,324,289 B2
(45) Date of Patent: May 10, 2022

(54) DETACHABLE CLASP

(71) Applicant: J.Schapson Innovations LLC, Houston, TX (US)

(72) Inventor: Jacob Andrew Schapson, Houston, TX (US)

( * ) Notice: Subject to any disclaimer, the term of this patent is extended or adjusted under 35 U.S.C. 154(b) by 0 days.

(21) Appl. No.: 17/198,501

(22) Filed: Mar. 11, 2021

(65) Prior Publication Data

US 2021/0307457 A1 Oct. 7, 2021

Related U.S. Application Data

(60) Provisional application No. 63/006,220, filed on Apr. 7, 2020.

(51) Int. Cl.

| | |
|---|---|
| ***A44B 18/00*** | (2006.01) |
| ***A44B 11/25*** | (2006.01) |
| ***A45F 5/02*** | (2006.01) |
| *A45F 5/00* | (2006.01) |

(52) U.S. Cl.
CPC ..... *A44B 18/0073* (2013.01); *A44B 11/258* (2013.01); *A45F 5/021* (2013.01); *A44D 2203/00* (2013.01); *A45F 2005/006* (2013.01)

(58) Field of Classification Search
CPC ..... A44B 11/258; A44D 2203/00
See application file for complete search history.

(56) References Cited

U.S. PATENT DOCUMENTS

| | | | | |
|---|---|---|---|---|
| 2,615,227 | A | 10/1952 | Hornik | |
| 3,027,617 | A * | 4/1962 | Gray | A44B 11/258 70/459 |
| 3,054,201 | A | 9/1962 | Burns | |
| 3,237,326 | A | 3/1966 | Naffin | |
| 3,293,714 | A | 12/1966 | Shafer | |
| 4,399,595 | A | 8/1983 | Yoon et al. | |
| 4,622,726 | A | 11/1986 | Nakamura | |
| 5,664,298 | A | 9/1997 | Nessar-Ivanovic | |
| 6,163,938 | A | 12/2000 | Weber-Unger | |
| 6,505,385 | B2 | 1/2003 | Grunberger | |
| 7,222,796 | B2 | 5/2007 | Taras | |
| 7,380,357 | B2 | 6/2008 | Jones et al. | |

(Continued)

FOREIGN PATENT DOCUMENTS

KR 10-1404022 B1 6/2014

*Primary Examiner* — Robert Sandy

(74) *Attorney, Agent, or Firm* — Madan Law; Jeffrey L. Streets

(57) ABSTRACT

A clasp includes a base member with a first magnetic element and a detachable member with a second magnetic element. The first magnetic element is positioned within a lateral groove in the base member and the second magnetic element is position on a tongue of the detachable member. A first cleat in the base member engages second cleat on the tongue when the tongue is secured in a seated position within the lateral groove. The magnetic elements bias the tongue into the seated position within the lateral groove in response to positioning the second cleat over the first cleat and then moving the second magnetic element into proximity with the first magnetic element. The detachable member may be detached from the base member by applying a lateral force that overcomes friction between the members and magnetic forces between the magnetic elements to slide the tongue laterally through the lateral groove.

20 Claims, 8 Drawing Sheets

(56) References Cited

U.S. PATENT DOCUMENTS

| | | | | |
|---|---|---|---|---|
| 7,980,012 | B2 | 7/2011 | Peterson et al. | |
| 9,307,808 | B1 | 4/2016 | Lill | |
| 9,605,696 | B1 | 3/2017 | May | |
| 10,085,521 | B2 | 10/2018 | Chen et al. | |
| 10,111,500 | B2 | 10/2018 | Lambert | |
| 10,376,022 | B2 | 8/2019 | Duncan et al. | |
| 10,617,179 | B2 * | 4/2020 | Fiedler | A44B 11/2588 |
| 2004/0107547 | A1 | 6/2004 | Chung | |
| 2006/0282993 | A1 | 12/2006 | Dietz | |
| 2008/0265082 | A1 | 10/2008 | Angiuli | |
| 2010/0325844 | A1 | 12/2010 | Fiedler | |
| 2014/0020214 | A1 | 1/2014 | Ayvazian et al. | |
| 2014/0277103 | A1 * | 9/2014 | Esposito | A61B 17/1327 24/303 |
| 2019/0180653 | A1 | 6/2019 | Tan | |

* cited by examiner

DETACHABLE CLASP

CROSS-REFERENCE TO RELATED APPLICATIONS

This application is a nonprovisional patent application claiming the benefit of U.S. provisional patent application Ser. No. 63/006,220 filed on Apr. 7, 2020, which application is incorporated by reference herein in its entirety.

BACKGROUND

The present disclosure relates to a clasp for selectively securing an item.

Background of the Related Art

A clasp is a device for holding two parts or objects together, yet also allowing for the parts or objects to be separated. Clasps are in common use to secure jewelry, watches, and other items. A clasp is preferably easy for an individual to use for both attaching and detaching, yet secured against accidental detachment.

BRIEF SUMMARY

One embodiment provides a clasp comprising a base member, a detachable member, and first and second magnetic elements. The base member includes a lateral groove having an upper edge, lower edge, a first surface extending between the upper and lower edges, and an open end, wherein the lower edge forms a first cleat angled upwardly away from the first surface. The first magnetic element is secured in a recess within the first surface of the base member. The detachable member includes a tongue having an upper edge, lower edge and a second surface extending between the upper and lower edges, wherein the lower edge of the tongue forms a second cleat angled downwardly toward the second surface, and wherein the tongue is receivable in a seated position within the lateral groove with the second cleat in contact with the first cleat, the first surface in contact with the second surface, and a gap between the upper edge of the lateral groove and the upper edge of the tongue. The second magnetic element is secured in a recess within the second surface of the detachable member, wherein the first and second magnetic elements bias the tongue into the seated position within the lateral groove in response to positioning the second cleat over the first cleat and then moving the second surface into proximity with the first surface. The detachable member is detachable from the base member by applying a lateral force that overcomes friction between the detachable member and base and magnetic forces between the first and second magnetic elements to slide the tongue laterally through the lateral groove beyond the open end.

DETAILED DESCRIPTION

Figure 1:
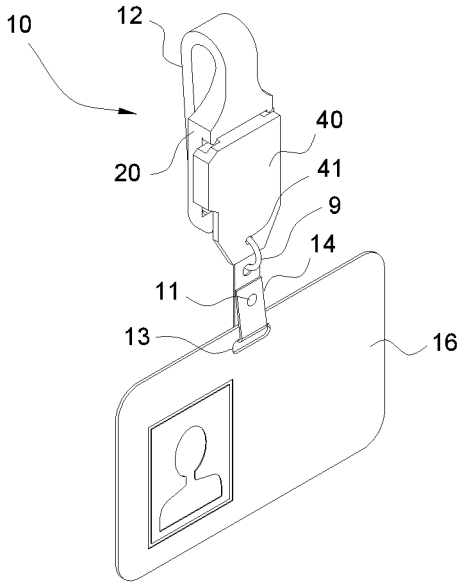
FIG. 1 is a perspective view of a clasp secured between a pocket clip and a badge clip.

One embodiment provides a clasp comprising a base member, a detachable member, and first and second magnetic elements. The base member includes a lateral groove having an upper edge, lower edge, a first surface extending between the upper and lower edges, and an open end, wherein the lower edge forms a first cleat angled upwardly away from the first surface. The first magnetic element is secured in a recess within the first surface of the base member. The detachable member includes a tongue having an upper edge, lower edge and a second surface extending between the upper and lower edges, wherein the lower edge of the tongue forms a second cleat angled downwardly toward the second surface, and wherein the tongue is receivable in a seated position within the lateral groove with the second cleat in contact with the first cleat, the first surface in contact with the second surface, and a gap between the upper edge of the lateral groove and the upper edge of the tongue. The second magnetic element is secured in a recess within the second surface of the detachable member, wherein the first and second magnetic elements bias the tongue into the seated position within the lateral groove in response to positioning the second cleat over the first cleat and then moving the second surface into proximity with the first surface. The detachable member is detachable from the base member by applying a lateral force that overcomes friction between the detachable member and base and magnetic forces between the first and second magnetic elements to slide the tongue laterally through the lateral groove beyond the open end.

The term "clasp" is used to refer to a device having two members that are selectively securable together. The two members of the clasp are themselves attachable or attached to something else. In one non-limiting example, the clasp may be used to secure identification badges to an article of clothing, yet allow quick separation that facilitates the use of the badge for security scanning. An identification badge may include printed user identification information on an exterior surface that is viewable, and/or the badge may include electronic or other technology that may be used to gain access to computers, equipment, rooms, buildings, and the like. However, various systems may require various manipulations or gestures with the badge, such as swiping a badge with a magnetic stripe through a reader, placing a badge with an RFID tag into proximity with a reader, or inserting a badge with a microchip into a chip-reader. Furthermore, it may be beneficial to remove the badge from clothing in these or other situations, such as to hand the badge to another person for close inspection and/or to protect privacy when the user is in a public environment where the badge is no longer needed. However, it may also be important that the badge be securely attached to the clothing at other times to avoid any accidental removal or loss of the badge.

In some embodiments, the clasp may include a first clip secured to the base member. For example, the first clip may be secured to the back or upper end of the base member to avoid interfering with the lateral groove. In one option, the first clip may be designed to be selectively securable to a pocket, shirt collar, belt, lanyard or other wearable item. In some embodiments, the clasp may include a second clip secured to the detachable member. For example, the second clip may be secured to a lower end of the detachable member. In one option, the second clip may be designed to secure various personal items, such as an identification badge, secure access card, key, medical alert device, flash drive, etc. Non-limiting examples of a second clip include a badge strap, alligator clip, spring snap bolt, and threaded quick link. In a preferred example, the clasp may include both a first clip and a second clip so that the base member may be secured to an article of clothing and a personal item may be secured to the detachable member. In one specific example, the base member hangs from the first clip, the detachable member hangs from the base member when the tongue is in the seated position within the lateral groove, and the second clip hangs from the detachable member. An optional personal item may then hang from the second clip.

In some embodiments, the detachable member may have a forward-facing surface opposite the second surface that secures the second magnetic element. The forward-facing surface may itself display some design or attach some ornamentation or display object directly to the forward-facing surface. For example, a design may be a sports team insignia, an ornamentation may be imitation jewels, and a display object may be a plastic flower.

A desirable feature of some embodiments is that the personal item may be easily and securely attached to clothing or other structure, yet the personal item may be easily detached by separating the detachable member from the base member. Preferably, the tongue may be secured in the seated position within the lateral groove with a single hand of a user and may also be detached with a single hand of the user. Still, the detachment may be accomplished with the application of a lateral force between the tongue and the lateral groove, whereas other forces directed at a personal item secured to the detachable member or a random portion of the clasp may not result in detachment. Optionally, the detachable member may be detached from the base member by pivoting the detachable member away from the base member in the opposite manner or movement in which the two members are attached.

In some embodiments, the first and second surfaces are flat (generally planar), and optionally textured. Accordingly, the first and second surface may be in contact across their overlapping areas when the tongue is received in the seated position within the lateral groove. The surface area of contact, as well as any optional texture, may increase friction between the surfaces and thereby help to prevent accidental movement of the tongue within the lateral groove that could lead to detachment of the detachable member from the base member. Alternatively, one or more of the first and second surfaces may be made with, or be coated with, a material exhibiting a high coefficient of friction, such as rubber or a pliable polymer such as silicone. Furthermore, the first and second cleats may have complementary dimensions and angles to increase the surface area of engagement between the first and second cleats, and may be similar coated or textured.

In some embodiments, the base member may further include a first support surface extending downward from the first cleat, and the detachable member may further include a second support surface extending downward from the second cleat. Accordingly, the first and second support surfaces may be flush (face-to-face contact) when the tongue is in the seated position within the lateral groove. The first and second support surfaces may serve to stabilize the connection between the detachable member and the base member. In other words, the first and second support surfaces may deter accidental separation or detachment of the base and detachable member as the result of a downward tug on the detachable member.

In some embodiments, the first and second magnetic elements may both be permanent magnets. Alternatively, one of the first and second magnetic elements may be a permanent magnet and another of the first and second magnetic elements may be a ferromagnetic material. Non-limiting examples of the first and second magnetic elements may be rectangular, circular, ring-shaped (i.e., donut-shaped) or other polygonal or curvilinear shape.

In some embodiments, the first and second magnetic elements may be substantially aligned when the tongue is in the seated position within the lateral groove. Alternatively, the first and second magnetic elements may be slightly offset, such as with the first magnetic element, which is secured in a recess within the first surface of the base member, having a slightly lower central axis such that a magnetic pull force is always biasing the second surface of the tongue downward. Such offset, if any, should be a sufficiently small distance so as not to significantly reduce the overall magnetic pull force between the first and second magnetic elements.

In some embodiments, the first magnetic element may have an outward facing surface that is flush with the first surface, and the second magnetic element may have an outward facing surface that is flush with the second surface. Accordingly, the first and second magnetic elements may come into contact or into near contact when the tongue is received in the seated position within the lateral groove. The magnetic pull force between the first and second magnetic elements may be at its greatest when the first and second magnetic elements are flush mounted with respect to the first and second surfaces, respectively, since magnetic pull forces are a function of a distance of separation between the magnetic elements. Although the detachable member may be secured to the base member by a user positioning the second cleat over the first cleat and then moving the second surface into proximity with the first surface, the final movement of the tongue into the seated position may be imparted by the first and second magnetic elements pulling the tongue inwardly and/or downwardly into the seated position within the lateral groove.

In some embodiments, the gap between the upper edge of the lateral groove and the upper edge of the tongue is large enough to allow the tongue to rotate a few degrees around a magnetic axis defined by the first and second magnetic elements and lock the detachable member against further lateral movement relative to the base such that the detachable member does not detach from the base. The magnetic axis defined by the first and second magnetic elements is preferably generally perpendicular to the first and second surfaces, and the rotation of the tongue about that axis may be accommodated with the first and second surfaces still in contact. The geometry of the tongue and the lateral groove may allow some rotation, but then the tongue and lateral groove will jam or lock against each other such that lateral sliding is resisted. More specifically, the corners of the upper edge of the tongue will press against the upper edge of the lateral groove.

In some embodiments, the clasp may include a pair of lugs extending downward from opposing lateral ends of the upper edge of the lateral groove. A pair of notches may also be formed in the upper edge of the tongue, wherein the pair of notches are vertically aligned with the pair of lugs when the tongue is in the seated position within the lateral groove. If a rotational force is applied to the detachable member, the tongue may rotate about the axis of the magnetic elements until one of the notches is received around one of the lugs. The one of the lugs that receives the one of the notches limits lateral sliding of the tongue relative to the lateral groove so long as the one of the notches is received around the one of the lugs. However, the pair of lugs do not prevent detachment of the detachable member from the base member when the tongue is slid laterally in the lateral groove without rotation.

In some embodiments, the base member may have a first tab extending from a first lateral edge in a first lateral direction beyond a first lateral edge of the detachable member when the tongue is in the seated position within the lateral groove, and the detachable member may have a second tab extending from a second lateral edge in a second lateral direction beyond a second lateral edge of the base member when the tongue is in the seated position within the lateral groove. Preferably, the first and second tabs may be laterally aligned with the first and second magnetic elements, respectively. A simultaneous application of lateral forces to the first and second tabs, such as by squeezing, may cause the tongue to slide laterally within the lateral groove until the first and second magnetic elements are no longer aligned or imparting any significant magnetic pull there between. For example, a first finger may be placed against the first tab and a thumb on the same hand as the first finger may be place against the second tab. Then, by squeezing or pinching the first finger and thumb together, the tongue will slide laterally within the lateral groove until the first and second magnetic elements are no longer aligned or imparting any significant magnetic pull there between. Accordingly, the base member and detachable member can be easily and quickly separated with one hand.

In some embodiments, the lateral groove is open at both ends. Having the lateral groove open at both ends may simplify attachment of the detachable member and the base member, since the lateral alignment of the tongue into the lateral groove is not so critical. Furthermore, having the lateral groove open at both ends may simplify manufacturing and may allow the same motion to separate the detachable member from the base member even if the clasp has flipped around, for example with the detachable member facing a person that is wearing the clasp and the base member facing outward away from the person.

The base member and the detachable member are preferably made with a non-magnetic material, such as a plastic. In this manner, the magnetic pull forces are governed solely by the size, shape and positioning of the first and second magnetic elements. Furthermore, the base member and the detachable member are preferably also lightweight and rigid.

FIG. 1 is a perspective view of a clasp 10 secured between a pocket clip 12 and a badge clip or strap 14 that is coupled to a badge 16. The clasp 10 includes a base member 20 and a detachable member 40. The base member 20 and the detachable member 40 are shown in a secured position. The pocket clip 12 may be secured to clothing, such as a pocket or neck of zero collar shirt, or even a lanyard. The clasp 10 may position the badge 16 for display to others, perhaps displaying a person's name, a person's picture, authorization information, or other details. For example, the badge 16 may include a slot 13 that receives the badge strap 14, which may be secured back to itself with a fastener 11 to form a loop. The strap 14 is then secured to the detachable member 40 using a ring 9 that passes through a hole in the strap 14 and a hole 41 in the lower end of the detachable member 40.

However, the detachable member 40 may be easily and quickly detached from the base member 20 for various purposes, such as to use the badge for purposes other than display. For example, the pocket clip 12 and base member 20 may remain secured to a pocket, while the detachable member 40 is detached from the base member 20 so that the badge 16 may be swiped through a card reader, held in proximity to a chip reader, or handed to another person for close inspection of information written on the badge.

Figure 2:
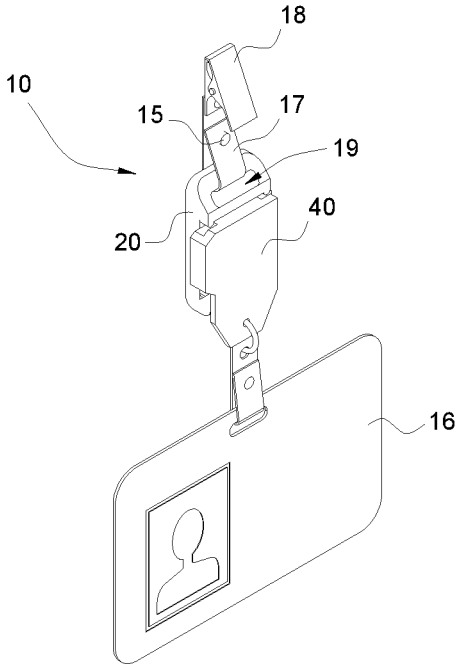
FIG. 2 is a perspective view of a clasp secured between an alligator clip and a badge clip.

FIG. 2 is a perspective view of the clasp 10 secured between an alligator clip 18 and the badge strap 14. In order to accommodate the alligator clip 18, the pocket clip 12 (shown in FIG. 1) has been replaced with a lateral slot 19. The alligator clip 18 may include a plastic strap 17 that is inserted through the slot 19 and secured back to itself with a fastener 15, such as a snap or rivet, to form a loop.

Figure 3A:
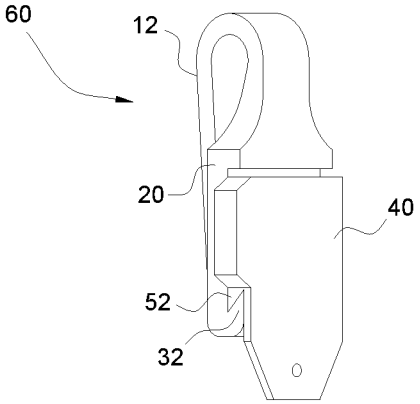
FIG. 3A is a perspective view of the clasp with the detachable member secured to the base member.

FIG. 3A is a perspective view of a clasp 60 with the detachable member 40 secured to the base member 20. The pocket clip 12 is shown for context, but may be replaced with another type of clip or fastener, depending upon the end use of the clasp 50.

Figure 3B:
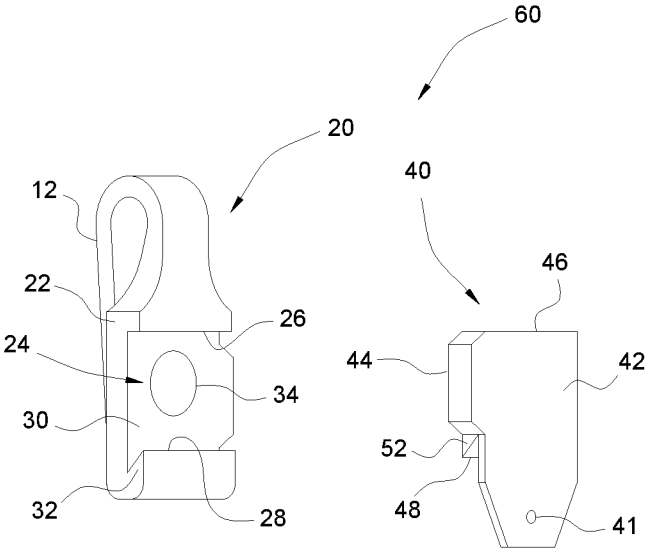
FIG. 3B is a perspective view of a base member having a first surface that secures a first magnetic element and a detachable member that has been detached from the base member.

FIG. 3B is a perspective view of the clasp 60 including the base member 20 having a first surface that secures a first magnetic element and the detachable member 40 that has been detached from the base member. The base member 20 has a main body 22 and a lateral groove 24 extending through the main body 22. The lateral groove 24 includes an upper edge 26, a lower edge 28, and a first surface 30 extending between the upper and lower edges 26, 28. In this embodiment, the upper edge 26 is generally flat along a lateral direction. The lower edge 28 forms a first cleat 32 that angles upward and away from the first surface 30. The first surface 30 is preferably flat and has a recess (not shown) securing a round (circular) magnetic element 34.

The detachable member 40 is shown separated from the base member 20, but having the orientation in which the detachable member 40 would be when attached to the base member 20. The detachable member 40 includes a main body 42 and a tongue 44 that extends out of the plane of the main body 42 (i.e., toward the base member 20). The tongue 44 has an upper edge 46, a lower edge 48 and a second surface (not shown) extending between the upper and lower edges 46, 48. The lower edge 48 of the tongue 44 forms a second cleat 52 angled downwardly and away from a plane of the main body 42 toward the second surface. A lower end of the detachable member 40 has a hole 41 for attaching a clip, such as the badge clip 14 shown in FIG. 1. Other attachment features or mechanisms may be used in place of, or in combination with, the hole 41 for attaching an item, such as a badge, key, or personal alert device. In a further option, the forwarding-facing surface of the main body 42 may display some design or attach some ornamentation or a display object directly to the forward-facing surface. For example, a design may be a sports team insignia, an ornamentation may be imitation jewels, and a display object may be a plastic flower. If the forwarding-facing surface of the main body 42 is used in this manner, the lower end of the detachable member 40 that includes the hole 41 may optionally be eliminated.

Figure 3C:
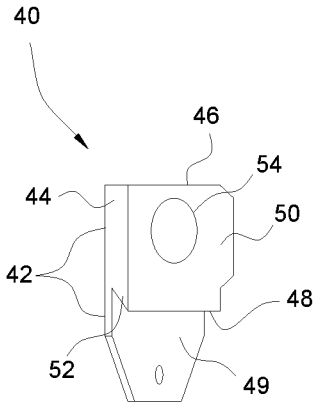
FIG. 3C is a perspective view of the detachable member having a second surface that secures a second magnetic element.

FIG. 3C is a perspective view of the detachable member 40 of FIG. 3A as seen from the reverse side relative to FIG. 3B to show the second surface that secures a second magnetic element 54. Again, the tongue 44 extends out of the plane of the main body 42 (i.e., out of the page as shown in FIG. 3C). The tongue 44 has an upper edge 46, a lower edge 48 and a second surface 50 extending between the upper and lower edges 46, 48. The lower edge 48 of the tongue 44 forms a second cleat 52 angled downwardly and away from a plane of the main body 42 toward the second surface 50. In one option, the second cleat 52 may have a complementary angle and complementary dimensions to the first cleat 32 of the base member 20 (as shown in FIG. 3B). The second surface 50 includes a recess (not shown) that secures a second magnetic element 54. For example, the second magnetic element 54 may be have an exposed surface that is flush with the second surface 50.

Referring back to FIG. 3A, the tongue 44 (see FIG. 3B) of the detachable member 40 is in a seated position within the lateral groove 24 (see FIG. 3B) of the base member 20. In the seated position, the second cleat 52 of the detachable member 40 is in contact with the first cleat 32 of the base member 20, and the second surface 50 (see FIG. 3C) of the detachable member 40 is in contact with the first surface 30 (see FIG. 3B) of the base member 20. Accordingly, the second magnetic element 54 (see FIG. 3C) of the detachable member 40 is aligned with the first magnetic element 34 (see FIG. 3B) of the base member 20 such that a magnetic pull biases the detachable member 40 and the base member 20 together. Furthermore, the magnetic pull opposes, but does not prevent, any movement (axial, lateral, vertical) that would cause separation of the first and second magnetic elements 34, 54. However, the detachable member 40 may be quickly and easily attached and detached from the base member 20 as will be described in detail below.

Figure 4A:
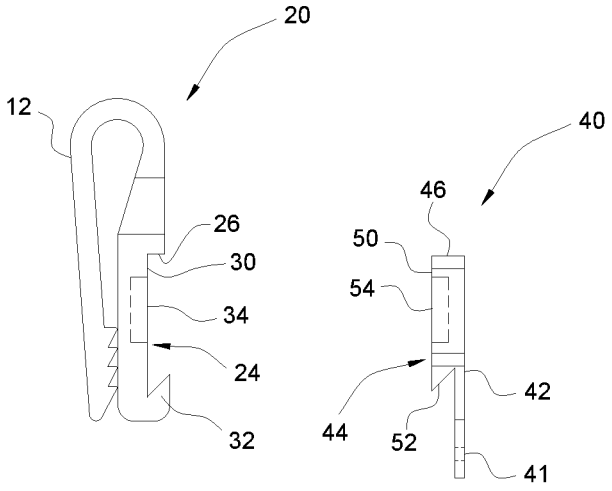
FIG. 4A is a side view of a detachable member that is ready to be attached to a base member.

FIG. 4A is a side view of the detachable member 40 that may be attached to the base member 20. As described previously in reference to FIG. 3B, the base member 20 includes the lateral groove 24 (the profile of the lateral groove 24 is shown in FIG. 4A). The lateral groove 24 is defined by the upper edge 26, the lower edge forming the first cleat 32, and the first surface 30 extending between the upper edge 26 and the first cleat 32. The first magnetic element 34 is secured in a recess (see the dashed line) within the base member 20 to positioned a surface of the first magnetic element 34 flush with the first surface 30.

As described previously in reference to FIG. 3C, the detachable member 40 includes the tongue 44 extending out of the plane of the main body 42 (i.e., extending toward the base member 20 as shown in FIG. 4A). The tongue 44 is limited by the upper edge 46, the lower edge forming the second cleat 52 and the second surface 50 extending between the upper edge 46 and the second cleat 52. The second cleat 52 is angled downwardly and away from a plane of the main body 42 toward the second surface 50. As shown, the second cleat 52 has a complementary angle and complementary dimensions to the first cleat 32 of the base member 20. The second surface 50 includes a recess that secures the second magnetic element 54 so that an exposed surface of the second magnetic element 54 is flush with the second surface 50.

Figure 4B:
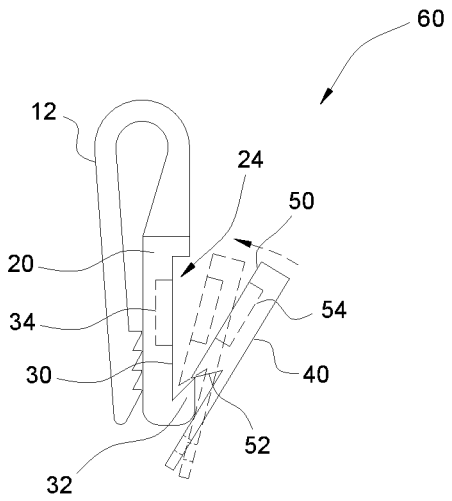
FIG. 4B is a side view of a detachable member having a cleat that is being positioned over a cleat of a base member.

FIG. 4B is a side view of the detachable member 40 (see solid outline of the detachable member) with its second cleat 52 positioned over the first cleat 32 of the base member 20. Then, the detachable member 40 (see dashed outline of the detachable member) is moved so that the second surface 50 and the second magnetic element 54 come into proximity with the first surface 30 and the first magnetic element 34. In this general position (perhaps closer or further), the magnetic pull of the first and second magnetic elements 34, 54 will draw the tongue of the detachable member 40 into the lateral groove 24 until reaching the seated position.

Figure 4C:
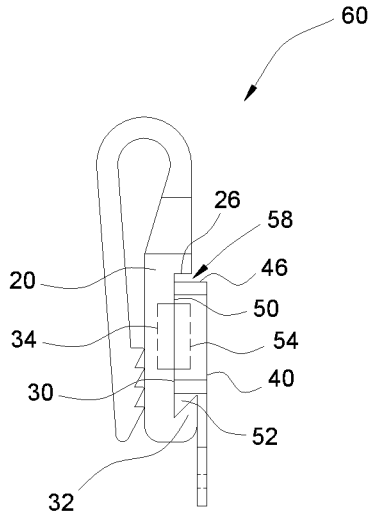
FIG. 4C is a side view of the clasp with the detachable member secured to the base member.

FIG. 4C is a side view of the clasp 60 with the detachable member 40 in the seated position relative to the base member 20. Accordingly, the second cleat 52 is in contact with the first cleat 32, the second surface 50 is in contact with the first surface 30, and the second magnetic element 54 is in contact with, or at least in close proximity with, the first magnetic element 34. The magnetic elements draw each other toward alignment as shown. Notice that in the seated position, there is a narrow gap 58 between the upper edge 46 of the tongue of the detachable member 40 and the upper edge 26 of the lateral groove of the base member 20. This narrow gap 58 enables the tongue to reach the seated position as the tongue rotates into the lateral groove (see FIG. 4B). However, in some embodiments, the narrow gap 58 is preferably not too wide (i.e., the distance between the opposing surfaces 26, 46), as will be describe in greater detail below.

Figure 5A:
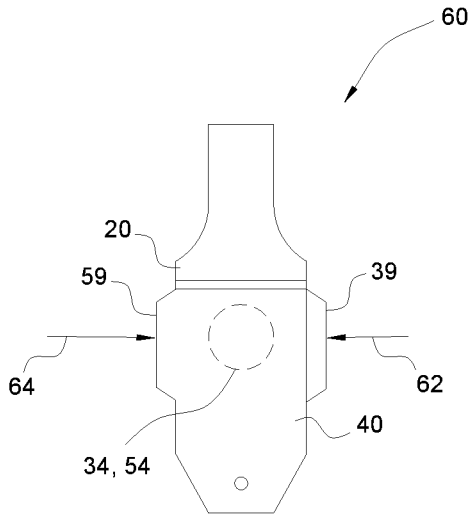
FIG. 5A is a front view of the clasp of FIG. 3A when the detachable member is in a seated position within the lateral groove of the base member.

FIG. 5A is a front view of the clasp 60 of FIG. 3A when the detachable member 40 is in a seated position with its tongue within the lateral groove of the base member 20 (see also FIG. 3A). In the embodiment shown, the base member 20 has a first tab 39 extending laterally beyond a lateral edge of the detachable member 40 (to the right side as shown in FIG. 5A), and the detachable member 40 has a second tab 59 extending laterally beyond a lateral edge of the base member 20 (to the left side as shown in FIG. 5A). The first and second tabs 39, 59 extend in opposite lateral directions and are both generally laterally aligned with the first and second magnetic elements 34, 54, respectively (their position is shown in dashed lines).

Figure 5B:
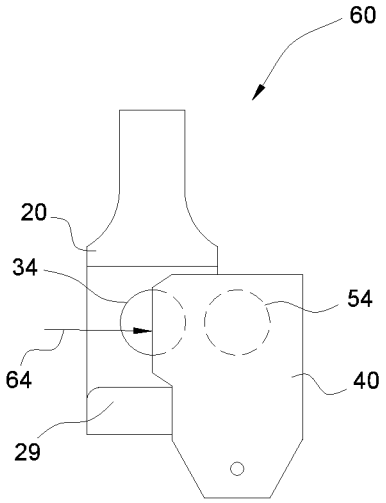
FIG. 5B is a front view of the clasp of FIG. 5A when the detachable member has been slid laterally relative to the base member to a point that the magnetic pull between the magnetic elements will no longer prevent the detachable member from being detached.
Figure 5C:
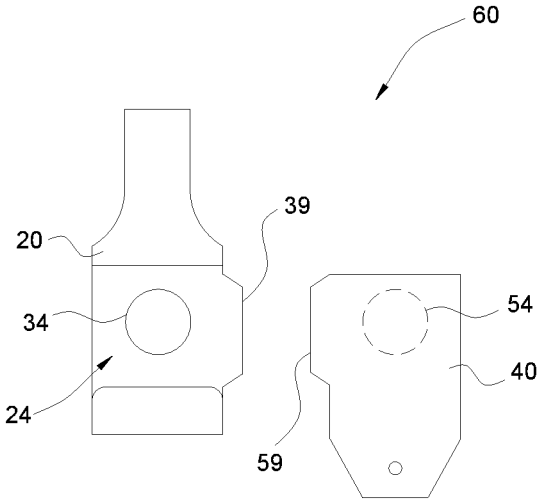
FIG. 5C is a front view of the clasp of FIG. 5B after the detachable member has been detached from the base member.

FIGS. 5A-5C illustrate one manner of detaching the detachable member 40 from the base member 20. In the seated position shown in FIG. 5A, a user may simultaneously apply lateral forces to the first tab 39 and second tab 59 in the direction of the two arrows 62, 64. The application of these lateral forces is facilitated by the first and second tabs 39, 59 which extend lateral and are the first thing a person will engage when preparing to laterally squeeze the clasp. Accordingly, a person does not even need to look directly at the clasp in order to detach the two members. To achieve any lateral sliding movement of the detachable member 40, the lateral forces must be sufficient to overcome friction between the surfaces 30, 50, between the cleats 32, 52, and perhaps also between a first support surface 29 (see FIG. 5B) extending downward from the first cleat of the base member 20 and a second support surface 49 (see FIG. 3C) extending downward from the second cleat of the detachable member 40. The first and second support surfaces 29, 49 may be flush (face-to-face contact) when the tongue is in the seated position within the lateral groove. The first and second support surfaces may serve to stabilize the connection between the detachable member and the base member. In other words, the first and second support surfaces may deter accidental separation or detachment of the base and detachable member as the result of a downward tug on the detachable member.

FIG. 5B is a front view of the clasp 60 of FIG. 5A when the detachable member 40 has been slid laterally relative to the base member 20 to a point that the magnetic pull between the magnetic elements 34, 54 will no longer resist against the detachable member 40 being detached. Still, the lateral forces cause the tongue to slide laterally within the lateral groove until the first and second magnetic elements 34, 54 are no longer aligned or imparting any significant magnetic pull there between.

FIG. 5C is a front view of the clasp 60 of FIG. 5B after the detachable member 40 has been detached from the base member 20. In this view, it is shown that the lateral groove 24 is open at each end. Accordingly, the detachable member 40 could be slid laterally in either direction (left or right as shown in FIGS. 5A-C) to accomplish detachment. However, the tabs 39, 59 make it convenient to simply squeeze the clasp 60 and exert a force on the tabs as they extend in opposing lateral directions. The tabs 39, 59 could each be formed on opposite edges of the base member and detachable member, such that applying a lateral squeezing force to the tabs would cause the detachable member 40 to become detached to the opposite direction (i.e., left as shown in FIG. 5C).

Figure 6:
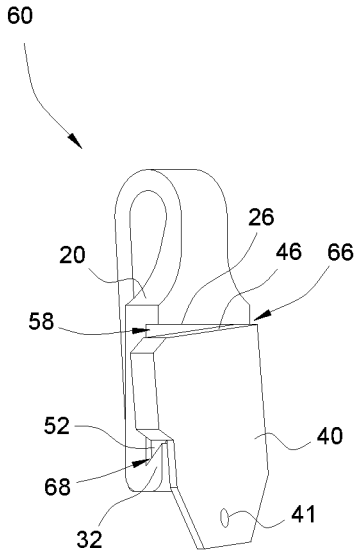
FIG. 6 is a perspective view of the clasp with the detachable member twisted within the lateral groove of the base member until the upper edge of the detachable member makes contact with the upper edge of a lateral groove in the base member.

FIG. 6 is a perspective view of the clasp 60 with the detachable member 40 rotated within the lateral groove of the base member 20 until a corner of the upper edge 46 of the detachable member 40 makes contact with the upper edge 26 of the base member 20. Such a rotation of the detachable member 40 might occur in response to a random lateral tug from the hole 41, such as if a badge hanging form the hole 41 was hit by an object. However, the forces that cause the detachable member 40 to become tilted will also apply a force at the points of contact 66, 68, such that the detachable member 40 will jam, lock or otherwise be prevented from sliding out the lateral groove.

Figure 7A:
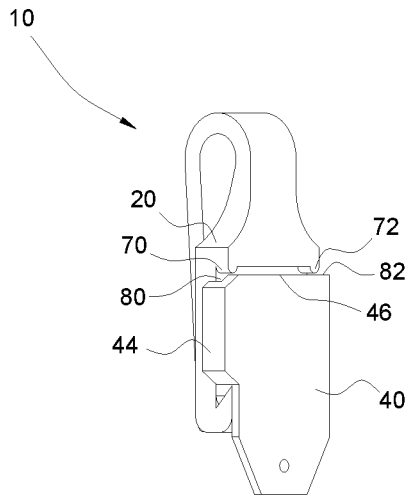
FIG. 7A is a perspective view of the clasp according to some embodiments, where the detachable member has a tongue in a seated position within a lateral groove of the base member.

FIG. 7A is a perspective view of the clasp 10 according to the embodiment shown in FIG. 1. The detachable member 40 has a tongue 44 in a seated position within the lateral groove of the base member 20 as in FIG. 3A. However, the clasp 10 has an additional feature. The upper edge 26 of the lateral groove 24 (see FIG. 7B) has a pair of lugs 70, 72. Each lug 70, 72 extends downwardly into the lateral groove 24 from one of the ends of the upper edge 26.

The upper edge 46 of the tongue 44 (see FIG. 7C) has a pair of notches 80, 82 that are spaced apart to vertically align with the pair of lugs 70, 72 when the tongue 44 is in the seated position within the lateral groove 24. Still, the lugs 70, 72 do not engage the notches 80 82 or the upper edge 46 of the detachable member 40 unless the detachable member 40 becomes tilted. So long as the detachable member 40 is slid laterally as shown in FIGS. 5A-C, the detachable member 40 can be easily detached as previously described.

Figure 7B:
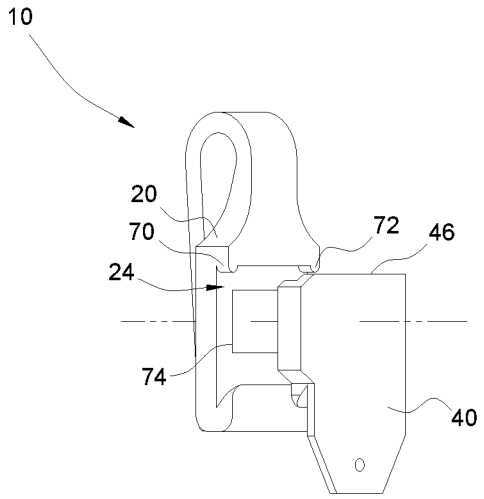
FIG. 7B is a perspective view of the detachable member of FIG. 7A detached from the base member.

FIG. 7B is a perspective view of the detachable member 40 of FIG. 7A disconnected from the base member 20. This view further illustrates the position, shape and size of the lugs 70, 72. The base member 20 is also shown with an optional rectangular magnetic element 74. Other features of the clasp 10 in FIG. 7B are similar to those of the clasp 60 in FIG. 3A and related Figures.

Figure 7C:
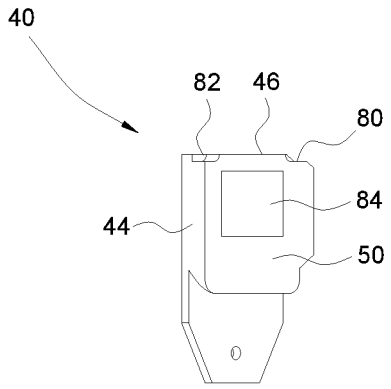
FIG. 7C is a perspective view of the detachable member of FIG. 7A showing a surface of a tongue that includes a magnetic element.

FIG. 7C is a perspective view of the detachable member 40 of FIG. 7A showing a surface 50 of the tongue 44 that includes a rectangular magnetic element 84. The rectangular magnetic element 84 is preferably positioned so that it will align with the rectangular magnetic element 74 of the base member 20 when the tongue 44 is in the seated position within the lateral groove 24. Furthermore, the notches 80, 82 are shown in opposing corners of the upper edge 46 of the detachable member 40.

Figure 7D:
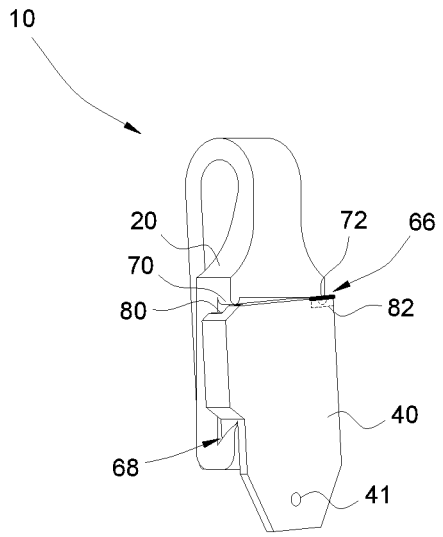
FIG. 7D is a perspective view of the clasp of FIG. 7A with the detachable member twisted within the lateral groove of the base member until a lug on the upper edge of the lateral groove in the base member makes contact with a notch in the detachable member.

FIG. 7D is a perspective view of the clasp 10 of FIG. 7A with the detachable member 40 twisted or rotated within the lateral groove 24 of the base member 20 until one of the lugs 70, 72 (see lug 72 shown in dashed lines on the right hand side as illustrated in FIG. 7D) on the upper edge 26 of the base member 20 makes contact with, or otherwise engages, one of the notches 80, 82 (see notch 82 shown in dashed lines on the right hand side as illustrated in FIG. 7D) in the detachable member 40. In this position, the detachable member 40 is locked into the lateral groove of the base member 20 since the notch 82 cannot slide passed the lug 72. Accordingly, a random lateral tug on the hole 41, or personal item handing from the hole 41, will not result in detachment of the detachable member 40.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A clasp, comprising:

a base member including a lateral groove having an upper edge, lower edge, a first surface extending between the upper and lower edges, and an open end, wherein the lower edge forms a first cleat angled upwardly away from the first surface;

a first magnetic element secured in a recess within the first surface of the base member;

a detachable member including a tongue having an upper edge, lower edge and a second surface extending between the upper and lower edges, wherein the lower edge of the tongue forms a second cleat angled downwardly toward the second surface, and wherein the tongue is receivable in a seated position within the lateral groove with the second cleat in contact with the first cleat, the first surface in contact with the second surface, and a gap between the upper edge of the lateral groove and the upper edge of the tongue; and a second magnetic element secured in a recess within the second surface of the detachable member, wherein the first and second magnetic elements bias the tongue into the seated position within the lateral groove in response to positioning the second cleat over the first cleat and then moving the second surface into proximity with the first surface, and wherein the detachable member is detachable from the base member by applying a lateral force that overcomes friction between the detachable member and base and magnetic forces between the first and second magnetic elements to slide the tongue laterally through the lateral groove beyond the open end.

2. The clasp of claim 1, wherein the first and second cleats have complementary dimensions and angles.

3. The clasp of claim 1, wherein the gap between the upper edge of the lateral groove and the upper edge of the tongue is large enough to allow the tongue to rotate around a magnetic axis defined by the first and second magnetic elements and lock the detachable member against lateral movement relative to the base such that the detachable member does not detach from the base.

4. The clasp of claim 1, wherein the first and second magnetic elements are substantially aligned when the tongue is in the seated position within the lateral groove.

5. The clasp of claim 1, wherein the base member includes a first support surface extending downward from the first cleat, wherein the detachable member includes a second support surface extending downward from the second cleat, and wherein the first and second support surfaces are flush when the tongue is in the seated position within the lateral groove.

6. The clasp of claim 1, wherein the base member has a first tab extending from a first lateral edge in a first lateral direction beyond a first lateral edge of the detachable member when the tongue is in the seated position within the lateral groove, wherein the detachable member has a second tab extending from a second lateral edge in a second lateral direction beyond a second lateral edge of the base member when the tongue is in the seated position within the lateral groove, and wherein the first and second tabs are both laterally aligned with the first and second magnetic elements.

7. The clasp of claim 6, wherein the simultaneous application of lateral forces to the first and second tabs causes the tongue to slide laterally within the lateral groove until the first and second magnetic elements are no longer aligned or imparting any significant magnetic pull there between.

8. The clasp of claim 1, further comprising:

a first clip secured to the base member.

9. The clasp of claim 8, wherein the first clip is selectively securable to a pocket, shirt collar, belt, lanyard or other wearable item.

10. The clasp of claim 8, further comprising:

a second clip secured to the detachable member.

11. The clasp of claim 10, wherein the first clip is secured to an upper end of the base member, and wherein the second clip is secured to a lower end of the detachable member.

12. The clasp of claim 10, wherein the second clip is a badge strap.

13. The clasp of claim 10, wherein the base member hangs from the first clip, the detachable member hangs from the base member when the tongue is in the seated position within the lateral groove, and the second clip hangs from the detachable member.

14. The clasp of claim 1, wherein the first and second surfaces are flat, the first magnetic element is flush with the first surface, and the second magnetic element is flush with the second surface.

15. The clasp of claim 14, wherein the first and second surfaces are textured.

16. The clasp of claim 1, further comprising:

a pair of lugs extending downward from opposing lateral ends of the upper edge of the lateral groove; and a pair of notches formed in the upper edge of the tongue, wherein the pair of notches are vertically aligned with the pair of lugs when the tongue is in the seated position within the lateral groove.

17. The clasp of claim 16, wherein, in response to a rotational force on the detachable member, the tongue rotates about the magnetic elements until one of the notches is received around one of the lugs, wherein the one of the lugs receiving the one of the notches limits lateral sliding of the tongue relative to the lateral groove so long as the one of the notches is received around the one of the lugs, and wherein the pair of lugs do not prevent detachment of the detachable member from the base member when the tongue is slid laterally in the lateral groove without rotation.

18. The clasp of claim 1, wherein the first and second magnetic elements are both permanent magnets.

19. The clasp of claim 1, wherein one of the first and second magnetic elements is a permanent magnet and another of the first and second magnetic elements is a ferromagnetic material.

20. The clasp of claim 1, wherein the lateral groove is open at both ends.

* * * * *